United States Patent [19]

Tezuka et al.

[11] 4,166,506

[45] Sep. 4, 1979

[54] CONTROLLING APPARATUS FOR BULLDOZER BLADE

[75] Inventors: Iwao Tezuka; Chikashi Chagawa, both of Hirakata, Japan

[73] Assignee: Kabushiki Kaisha Komatsu Seisakusho, Tokyo, Japan

[21] Appl. No.: 837,421

[22] Filed: Sep. 28, 1977

Related U.S. Application Data

[63] Continuation-in-part of Ser. No. 653,905, Jan. 30, 1976, abandoned.

[30] Foreign Application Priority Data

Jun. 30, 1975 [JP] Japan ..... 50/80693
Jun. 30, 1975 [JP] Japan ..... 50/80699

[51] Int. Cl.[2] ..... E02F 3/76

[52] U.S. Cl. ..... 172/4.5; 172/803; 91/453; 91/459; 91/461; 91/512; 91/529

[58] Field of Search ..... 91/414, 453, 459, 461, 91/512, 529; 172/4.5, 7, 9, 10, 11, 803

[56] References Cited

U.S. PATENT DOCUMENTS

| | | | |
|---|---|---|---|
| 2,778,130 | 1/1957 | Gurries | 172/4.5 |
| 3,009,271 | 11/1961 | Kuchne | 172/4.5 |
| 3,831,683 | 8/1974 | Ikeda | 172/4.5 |
| 3,842,714 | 10/1974 | Coleman | 91/414 |
| 4,017,110 | 4/1977 | Pease | 91/414 |
| 4,031,964 | 6/1977 | Takahashi | 172/9 |

FOREIGN PATENT DOCUMENTS

| | | | |
|---|---|---|---|
| 49-1081 | 1/1974 | Japan . | |
| 1290535 | 9/1972 | United Kingdom | 172/4.5 |

*Primary Examiner*—Abraham Hershkovitz
*Attorney, Agent, or Firm*—Armstrong, Nikaido, Marmelstein & Kubovcik

[57] ABSTRACT

A controlling apparatus for bulldozer blade in which the control is carried out automatically or manually.

The apparatus comprises an electromagnetic valve for controlling a cylinder of the bulldozer blade, a switch for changing the control of the bulldozer blade automatically or manually, a safety relay connected with said switch, the safety relay being adapted to be actuated only when the switch is maintained in a manual operating position, and a load reading relay adapted to be actuated by a signal fed from a load detecting circuit for supplying a signal to one of the solenoids of the electromagnetic valve.

9 Claims, 25 Drawing Figures

CONTROLLING APPARATUS FOR BULLDOZER BLADE

CROSS REFERENCE TO RELATED APPLICATION

This application is a continuation-in-part application of our prior U.S. application Ser. No. 653,905 filed Jan. 30, 1976, now abandoned, entitled "CONTROLLING APPARATUS FOR BULLDOZER BLADE".

BACKGROUND OF THE INVENTION

This invention relates to a controlling apparatus for a bulldozer blade.

There have been used bulldozer blade controlling units of two types, one is of a type that laser beam is projected from a laser transmitter to produce a reference plane and the bulldozer detects and receives the beam so as to maintain the bulldozer blade at a fixed height relative the reference plane; and the other is of a type that an angle sensor is installed on a push beam fixedly securing the bulldozer blade for the purpose of maintaining the bulldozer blade at a constant inclination. However, the former is disadvantageous in that it is complicated and costly in construction and its operation is subjected to the influence of dirt, whilst the latter has a demerit that its operation is influenced by the vibration inherent to the bulldozer itself.

SUMMARY OF THE INVENTION

In accordance with the present invention a controlling apparatus for a bulldozer blade in which the control is carried out automatically or manually comprises an electromagnetic valve for controlling a cylinder of the bulldozer blade, switching means for selectively switching manual and automatic controls of the bulldozer blade, a safety relay connected to said switching means, the safety relay being actuated only when the switching means is maintained in a manual operating position, a preferential relay for manual operation to receive a signal from the safety relay, a load reading relay actuated by a signal from a load detecting circuit for supplying a signal from the preferential relay for manual operation to one of each solenoids of the electromagnetic valve, and switching means for opening an automatic circuit of the preferential relay for manual control when turned off in response to the operation of an operating lever.

It is the primary object of the present invention to provide a controlling apparatus for a bulldozer blade in which the control is carried out automatically or manually.

It is another object of the present invention to provide a controlling apparatus for a bulldozer blade in which the manual operation has a priority over the automatic operation and the manual operation can be effective during the automatic operation.

It is still another object of the present invention to provide a controlling apparatus for a bulldozer blade in which the frequency of blade operations can be minimized to reduce the fatigue of operators.

It is a further object of the present invention to provide a controlling apparatus for a bulldozer blade in which to level the ground can easily be carried out by non-trained operators by the action of a lower limit control switch during the automatic operation working.

Other objects, features and advantages of the present invention will be readily apparent from the following description taken in conjunction with the accompanying drawings.

DETAILED DESCRIPTION OF THE PREFERRED EMBODIMENTS

Figure 1:
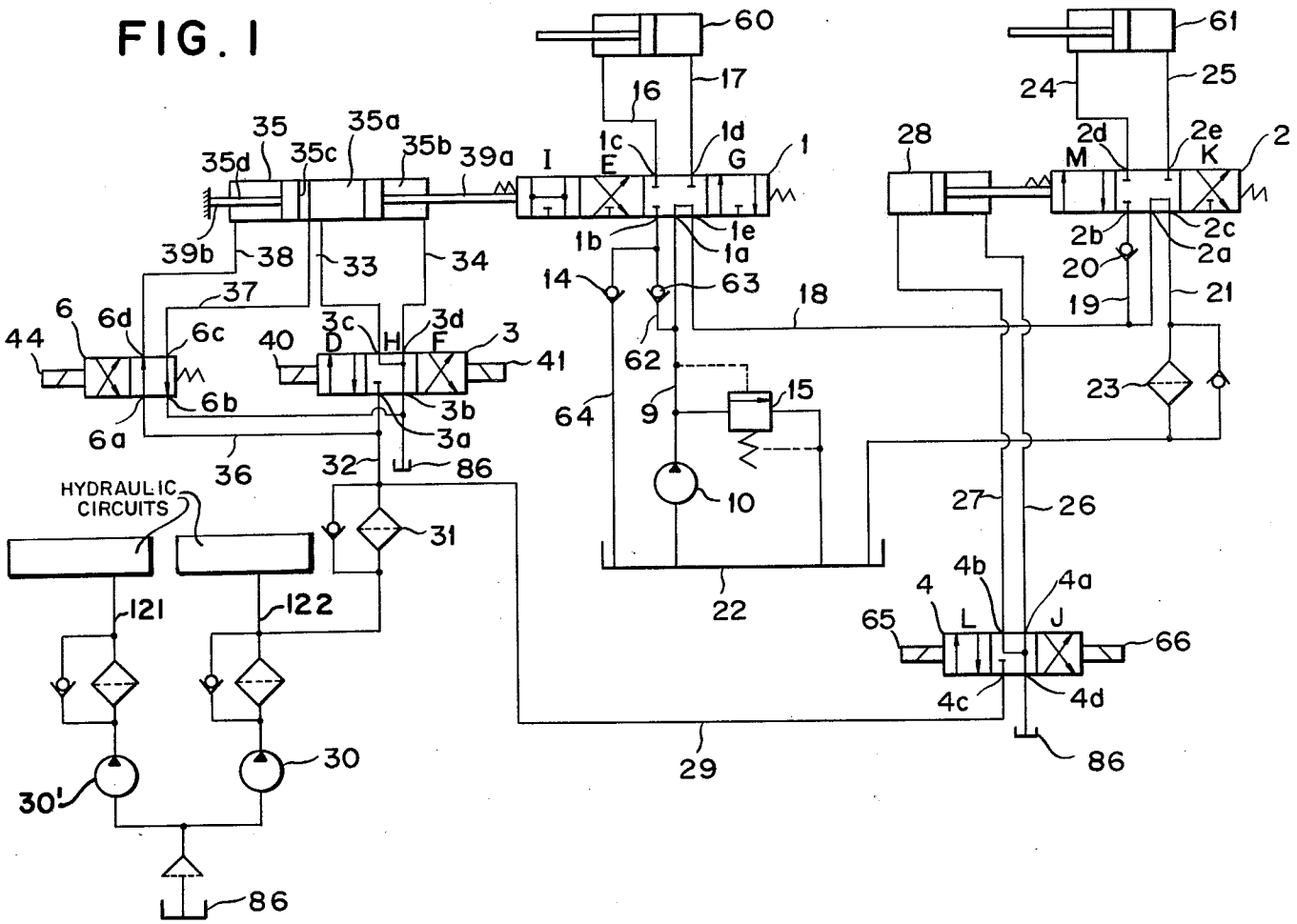
FIG. 1 is a hydraulic circuit of one embodiment of the present invention.

The present invention will now be described in detail below with reference to the accompanying drawings. In FIG. 1 which shows a first embodiment of the invention, reference numeral 1 denotes a bulldozer blade hoisting valve, 2 a bulldozer blade tilting valve, 3 an electromagnetic valve for hoisting the bulldozer blade, 4 an electromagnetic valve for tilting the bulldozer blade, 6 an electromagnetic valve for floating the bulldozer blade, 35 an operating cylinder for hoisting the bulldozer blade, 60 a hoist cylinder, and 61 a tilt cylinder. The bulldozer blade hoisting valve 1 has a port 1*a* which is connected through a pipeline 9 to a pump 10. A branch pipe 62 extends from the pipeline 9 and is connected to a port 1*b*. The branch pipeline 62 is provided with a check valve 63. A pipeline 64 is connected to the port 1*b* and is provided with a check valve 14. The pipeline 9 is provided with a relief valve 15. The bulldozer blade hoisting valve 1 has formed therein ports 1*c* and 1*d* which are connected through pipelines 16 and 17 to the rod and head sides of the hoist cylinder 60, respectively. The bulldozer blade hoisting valve 1 has a further port 1*e* which is connected through a pipeline 18 to a port 2*a* formed in the bulldozer blade tilting valve 2. The pipeline 18 has a branch pipeline 19 which is connected to a port 2*b* formed in the bulldozer blade tilting valve 2. The branch pipeline 19 is provided with a check valve 20. The bulldozer blade tilting valve 2 has a port 2*c* formed therein which is connected through a pipeline 21 with a tank 22. The pipeline 21 is provided with a filter 23. The bulldozer blade tilting valve 2 has formed therein further ports 2*d* and 2*e* which are connected through pipelines 24 and 25 to the rod and head sides of the tilt cylinder 61, respectively. The electromagnetic valve 4 for tilting the bulldozer blade has formed therein ports 4*a* and 4*b* which are connected through pipelines 26 and 27 with the rod and head sides of an operating cylinder 28 for tilting the bulldozer blade, respectively. The electromagnetic valve 4 for tilting the bulldozer blade has a port 4*c* formed therein which is connected through a pipeline 29 to a pump 30. The pipeline 29 is provided with a filter 31. A further port 4*d* formed in the electromagnetic valve 4 for tilting the bulldozer blade is connected to a tank 86. The electromagnetic valve 3 for hoisting the bulldozer blade has formed therein a port 3*a* which is connected through a pipeline 32 to the pump 30, and also has a port 3*b* which is connected to a tank 86. The electromagnetic valve 3 for hoisting the bulldozer blade has formed therein further ports 3*c* and 3*d* which are connected through pipelines 33 and 34, respectively, to one head side 35*a* and one rod side 35*b* of the operating cylinder 35 for hoisting the bulldozer blade. The electromagnetic valve 6 for floating the bulldozer blade has formed therein ports 6*a* and 6*b*, the former being connected through a pipeline 36 to the pump 30 and the latter being connected to the tank 86. The electromagnetic valve 6 for floating the bulldozer blade has formed therein further ports 6*c* and 6*d* which are connected through pipelines 37 and 38, respectively, to the other head side 35*c* and the other rod side 35*d* of the operating cylinder 35 for hoisting the bulldozer blade. The operating cylinder 35 for hoisting the bulldozer blade has rods 39*a* and 39*b* connected thereto, the former being connected to a spool slidably mounted in the bulldozer blade hoisting valve 1 and the latter being rigidly connected to a fixed member.

The aforementioned electromagnetic valve 3 for hoisting the bulldozer blade comprises a solenoid 40 for moving the bulldozer blade downwards and a solenoid 41 for moving the same upwards, whilst the electromagnetic valve 4 for tilting the bulldozer blade comprises left hand solenoid 65 and right hand solenoid 66. The electromagnetic valve 6 for floating the bulldozer blade comprises a solenoid 44. Respective one side terminals of the solenoids 40, 41, 65, 66 and 44 are all connected with a power supply 42. Pipelines 121 and 122 connect pumps 30 and 30' to other hydraulic circuits on the bulldozer.

Figure 2:
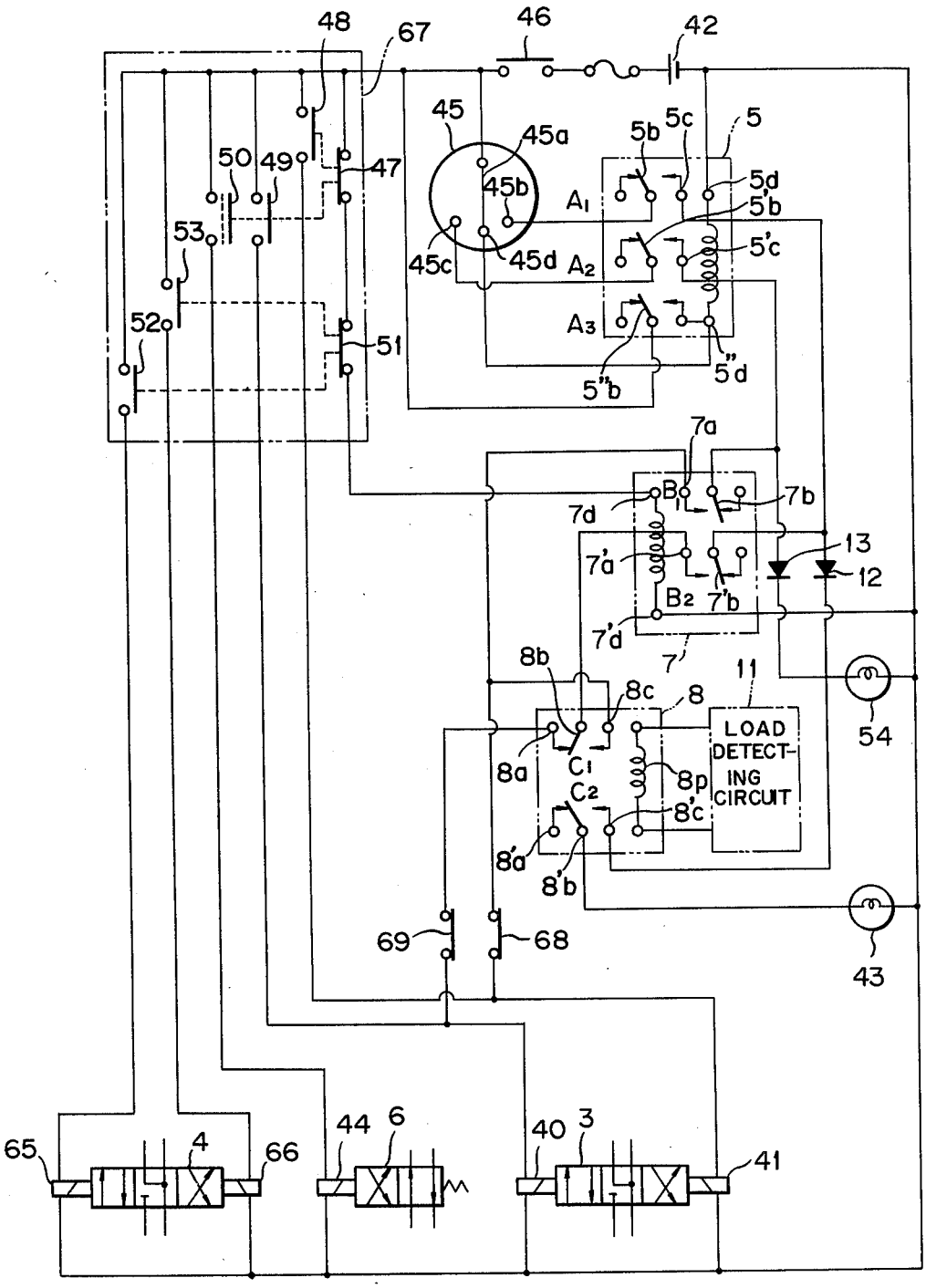
FIG. 2 is an electric circuit of the present invention for use with the hydraulic circuit of FIG. 1.

In FIG. 2 which shows an electric circuit of the first embodiment, reference numeral 67 denotes a manual operating switch unit comprising a switch 47, a switch 48 for moving the bulldozer blade upwards, a switch 49 for moving the same downwards, a switch 50 for floating the same, said switches 48, 49 and 50 being all interlocked with said switch 47, a switch 51, a switch 52 for tilting left hand of the bulldozer blade downwards, and a switch 53 for tilting right hand of the same downwards, both of said switches 52 and 53 being interlocked with said switch 51. One side contacts of the switches 47, 48, 49, 50, 52 and 53 are all connected through a main switch 46 to the power supply 42.

Figure 7:
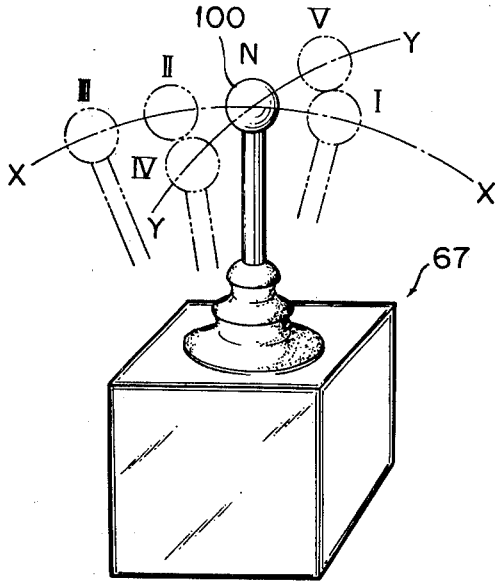
FIG. 7 is an explanatory view showing respective positions of an operating lever for a manual operating switch provided in the electric circuit shown in FIG. 2.

The manual operating switch unit 67 is operated by an operator through an operating lever 100 so as to be selectively shifted into six positions, namely I to V positions and a neutral position, as shown in FIG. 7. The relation between the respective shifting positions of the operating lever 100 and ON/OFF switching actions of the respective switches in the switch unit 67 and resultant movement of the bulldozer blade are shown in the following Table.

Table

| (*2) | (*1) 47 | 48 | 49 | 50 | 51 | 52 | 53 | MOVEMENT OF BULLDOZER BLADE |
|---|---|---|---|---|---|---|---|---|
| N | ON | OFF | OFF | OFF | ON | | OFF | HOLD IN POSITION |
| I | OFF | ON | OFF | OFF | ON | OFF | OFF | UP |
| II | OFF | OFF | ON | OFF | ON | OFF | OFF | DOWN |
| III | OFF | OFF | ON | ON | ON | OFF | OFF | FLOAT |
| IV | ON | OFF | OFF | OFF | OFF | ON | OFF | LEFTHAND TILT |
| V | ON | OFF | OFF | OFF | OFF | OFF | ON | RIGHTHAND TILT |

Remarks:
(*1) SWITCHES
(*2) POSITIONS OF OPERATING LEVER 100

The solenoid 40 of the electromagnetic valve 3 for hoisting the bulldozer blade has another terminal connected to another side contact of the switch 49 for moving the bulldozer blade downwards, and the other terminal of the solenoid 41 for moving the bulldozer blade upwards is connected with another side contact of the switch 48 for moving the bulldozer blade upwards. The other terminal of the solenoid 44 of the electromagnetic valve 6 for floating the bulldozer blade is connected with another side contact of the switch 50 for floating the bulldozer blade. Further, the left and right hand solenoids 65 and 66 of the electromagnetic valve 4 for tilting the bulldozer blade are connected with another side contact of the switch 52 for tilting left hand of the bulldozer blade downwards and with another side contact of the switch 53 for tilting right hand of the same downwards. Furthermore, the other terminal of the solenoid 41 for moving the bulldozer blade upwards is connected through an upper travel limit switch 68 with a contact 7*a* in switch part $B_1$ of a manual operation preferential relay 7, and with a contact 8*c* in switch part $C_1$ of a load reading relay 8.

Further, the other terminal of the solenoid 40 for moving the bulldozer blade downwards is connected through a lower travel limit switch 69 with a contact 8*a* in the switch part $C_1$ of the load reading relay 8. A contact 5*d* of a safety relay 5, a contact 7'*d* of the manual operation preferential relay 7 are connected to the power supply 42, and a contact 8'*b* in the switch part $C_2$ of the load reading relay 8 is also connected to the power supply 42 through an overload indicating lamp 43.

A contact 5*c* in the switch part $A_1$ of the safety relay 5 is connected through an automatic operation indicating lamp 54 and a diode 12 with the power supply 42, and a contact 5'*c* in the switch part $A_2$ of the safety relay 5 is also connected through the automatic operation indicating lamp 54 and a diode 13 with the power supply 42.

Further, the contact 5*c* in the switch part $A_1$ of the safety relay 5 and the contact 5'*c* in the switch part $A_2$ thereof are connected through the diodes 12 and 13, respectively, with a contact 8'*c* in the switch part $C_2$ of the load reading relay 8. A contact 5*c* in the switch part $A_1$ of the safety relay 5 is connected with a movable contact 7'*b* in the switch part $B_2$ of the manual operation preferential relay 7, and a contact 5'*c* in the switch part $A_2$ of the safety relay 5 is connected with a movable contact 7*b* in the switch part $B_1$ of the manual operation preferential relay 7.

The load reading relay 8 comprises a coil 8*p* connected to a load detecting circuit 11. Any type of load detecting circuit may be used which can send out a signal to energize the coil 8*p* only when the load imposed on the bulldozer blade exceeds a predetermined value. A movable contact 8*b* in the switch part $C_1$ of the load reading relay 8 is connected with a contact 7'*a* in the switch part $B_2$ of the manual operation preferential relay 7.

Figure 8:
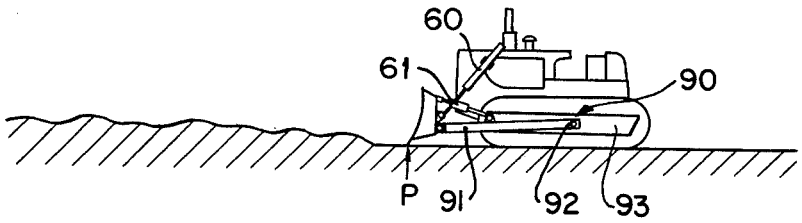
FIG. 8 is a side view of a bulldozer keeping in the condition just before start of excavating or levelling work thereof.

As for a device for detecting a load applied on the bulldozer blade, there are, in general, electric and hydraulic types. In the present invention, was used the detecting device 90 of electric type in which a strain gauge electrically connected to the circuit 11 was mounted on an intermediate portion of a push arm 91 supporting the bulldozer blade or mounted on a trunnion 92 fixedly secured to a track frame 93 of the bulldozer for pivotally suspending the push arm 91 as illustrated in FIG. 8.

In FIG. 2, reference numeral 45 represents an auto-manual change-over switch from automatic to manual operation and vice versa. The switch 45 comprises a movable contact 45*a* connected through the main switch 46 with the power supply 42. The switch 45 has also a contact 45*b* for automatic downward operation which is connected with a movable contact 5*b* in the switch part $A_1$ of the safety relay 5, and a contact 45*c* for automatic upward operation which is connected with a movable contact 5'*b* in the switch part $A_2$ of the safety relay 5. The switch 45 further comprises a contact 45*d* for manual operation which is connected with a contact 5''*d* of the safety relay 5. A movable contact 5''*b* in the switch part $A_3$ of the safety relay 5 is connected through the main switch 46 with the power supply 42. Further, one side contact of the switch 51 is connected with a contact 7*d* in the switch part $B_1$ of the manual operation preferential relay 7. Another side contact of the switch 51 is connected with another side contact of the switch 47.

With reference to the first embodiment shown in FIGS. 1 and 2, the manual and automatic modes of operation of the controlling apparatus of the present invention will now be described in detail hereinbelow.

MANUAL MODE OF OPERATION

In case of the manual controlling operation of the bulldozer blade, it should be noted that the operation is not systematically performed, but carried out of the operator's free-will. However, in order to compare the manual controlling operation with the automatic one described afterwards, one manual controlling operation cycle which is anticipated as it will be carried out by the operator when levelling or excavating of the ground is hereinafter described with reference to the relation between the position of the operating lever 100 of the manual operating switch unit 67 and the movement of the bulldozer blade shown in the foregoing Table.

(a) From preparation to start of levelling or excavating work:

After starting the engine of the bulldozer, the movable contact 45*a* of the auto-manual changeover switch 45 is moved to connect it with the contact 45*d* for manual operation. Then, the main switch 46 is turned on. At that time only, the movable contacts 5*b*, 5'*b* and 5''*b* of the safety relay 5 are all closed to connect them with the contacts 5*c*, 5'*c* and 5''*d*, respectively, and moreover the movable contacts 7*b* and 7'*b* of the manual operation preferential relay 7 are also closed to connect them with the contact 7*a* and 7'*a*, respectively. In such conditions, the bulldozer blade is not automatically operated by the reason of disconnection of the contact 45*c* for automatic upward operation from the power supply 42, but operated in manual mode in response to the operation of the operating lever 100 of the manual operating switch unit 67. Successively, the bulldozer is driven to a point from which the levelling or excavating work is started, and the lower end of the bulldozer blade is put down on the ground, as shown in FIG. 8.

Figure 9A:
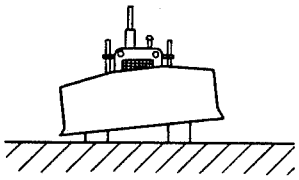
FIGS. 9A and 9B are front views of a bulldozer keeping in conditions as tilting a bulldozer blade to the right-hand and the left-hand sides.

(b) Adjustment of tilted blade:

(b-1) When the bulldozer blade is tilted such that its lefthand side is hoisted as shown in FIG. 9A, the tilt of the blade is levelled by the operation of the operating lever 100 such that the operating lever 100 is shifted from the neutral position N to the position IV shown in FIG. 7 and the foregoing Table. By this operation of the operating lever 100, the switch 51 is opened and the switch 52 is closed. In consequence, the solenoid 65 of the electromagnetic valve 4 is excited so that the valve position of the valve 4 is changed to a lefthand tilting position L, thereby extending the operating cylinder 28 for tilting adjustment of the bulldozer blade. Therefore, the valve position of the bulldozer blade tilting valve 2 is changed to a lefthand tilting position M so that the tilt cylinder 61 is rendered operative to tilt the lefthand side of the bulldozer blade downwards. Thus, the righthand tilted bulldozer blade can be adjusted to level. Thereafter, when the operating lever 100 is returned to the neutral position N, the switch 51 is closed and the switch 52 is opened so that the valve position of the electromagnetic valve 4 is changed from the position L to its neutral position where each side of cylinder chamber of the cylinder 28 is connected to the drain tank 86, thereby returning the bulldozer blade tilting valve 2 to its neutral position by the action of a spring provided therein. As a result, the tilt cylinder 61 is hydraulically locked so as to keep the bulldozer blade to be in level.

Figure 9B:
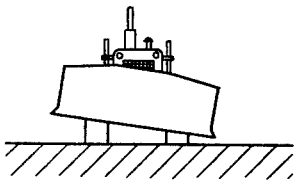

(b-2) When the bulldozer blade is tilted in a manner such that its righthand side is hoisted as shown in FIG. 9B, the operating lever 100 is shifted from the neutral position N to the position V so that the switch 51 is opened and the switch 53 is closed as described in the foregoing Table. In consequence, the solenoid 66 of the electromagnetic valve 4 is excited with the result that the valve position of the valve 4 is changed to a right-hand tilting position J, thereby retracting the operating cylinder 28 for tilting adjustment of the bulldozer blade. By the retractation of the cylinder 28, the valve position of the bulldozer blade tilting valve 2 is changed to a righthand tilting position K so that the tilt cylinder 61 is rendered operative to tilt the righthand side of the bulldozer blade downwards. Thus, the lefthand tilted bulldozer blade can be adjusted to level. After levelled, when the operating lever 100 is returned to the neutral position N, the switch 51 is closed and the switch 53 is opened so that the valve position of the electromagnetic valve 4 is changed to the neutral position where each side of cylinder chamber of the cylinder 28 is connected to the drain tank 86, thereby returning the valve 2 to its neutral position by the action of the spring. As a result, the tilt cylinder 61 is locked so as to keep the bulldozer blade level as is similar to the description in the previous paragraph (b-1).

Figure 10A:
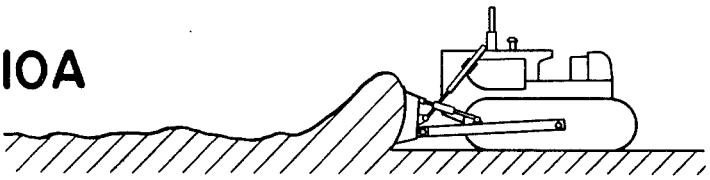
FIGS. 10A and 10C are explanatory views showing upwardly moving operation of the bulldozer blade in manual operation mode in the excavating or levelling work.
Figure 10B:
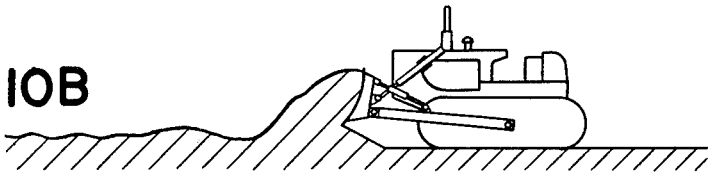
Figure 10C:
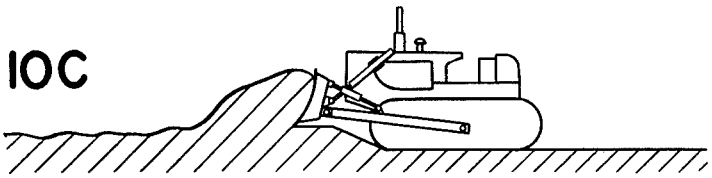

(C) Upward movement of the bulldozer blade:

When the bulldozer is forwarded from the condition shown in FIG. 8, excavated soil and sand are successively accumulated onto the front face of the bulldozer blade. As a result, the vehicle speed is decelerated, and yet the operator certainly feels a shoe slip of endless track assemblies. In such conditions, in order to reduce the load applied on the bulldozer blade the operator shifts the operating lever 100 of the manual operating switch unit 67 to the position I so as to move the bulldozer blade upwards as shown in FIGS. 10A to 10C.

In detail, when the operating lever 100 is shifted to the position I, the switch 47 is opened and the switch 48 is closed. In consequence, the solenoid 41 of the electromagnetic valve 3 for moving the bulldozer blade upwards is energized so that the valve position of the valve 3 is changed to a hoisting position F, thereby retracting the operating cylinder 35. By the retractation of the cylinder 35, the valve position of the bulldozer blade hoisting valve 1 is changed to a hoisting position G so that a piston rod of the hoist cylinder 60 is retracted, accordingly moving the bulldozer blade upwards. (From FIG. 10A to FIG. 10B)

Thereafter, when the operator feels the fact that the vehicle speed is accelerated and the shoe slip is eliminated by the hoist of the bulldozer blade, he returns the operating lever 100 to the neutral position N so that the switch 47 is closed and the switch 48 is opened. As a result, the solenoid 41 is deenergized so as to change the valve position of the valve 3 to the neutral position H, thereby changing the valve position of the valve 1 to the neutral position also by the action of a spring provided therein. Thus, the hoist cylinder 60 is hydraulically locked so as to keep the bulldozer blade in the hoisted position, and the bulldozer is driven as it is. (From FIG. 10B to FIG. 10C)

(d) Downward movement of the bulldozer blade:

When soil and sand accumulated onto the front face of the bulldozer blade are decreased by the upward movement of the bulldozer blade as described in the foregoing paragraph (c), the operator shifts the operating lever 100 of the manual operating switch unit 67 to the position II where the bulldozer blade is moved downwards.

Figure 11A:
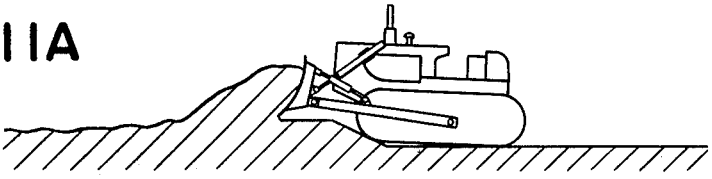
FIGS. 11A to 11C are explanatory views showing downwardly moving operation of the bulldozer blade in manual operation mode in the excavating or levelling work.
Figure 11B:
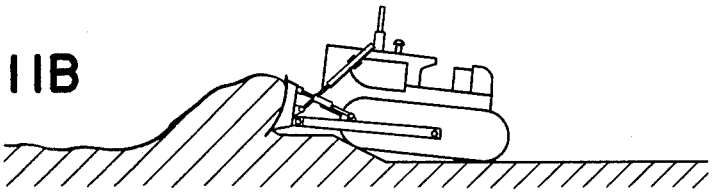
Figure 11C:
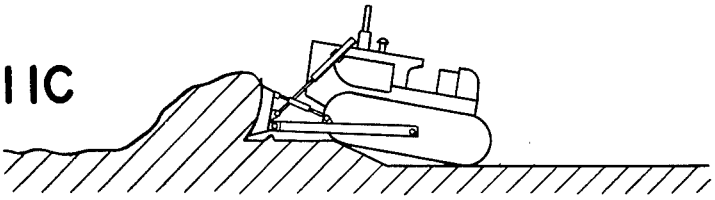

The downward movement of the bulldozer blade is hereinafter explained in detail with reference to FIGS. 11A to 11C.

When the operating lever 100 is shifted to the position II, the switch 47 is opened and the switch 49 is closed. In consequence, the solenoid 40 is excited so that the valve position of the valve 3 is changed to a lowering position D, thereby extending the operating cylinder 35. By the extension of the cylinder 35, the valve position of the valve 1 is changed to a lowering position E so that the piston rod of the hoist cylinder 60 is extended. Accordingly, the bulldozer blade is moved downwards. (From FIG. 11A to FIG. 11B)

Then, when soil and sand accumulated onto the front face of the bulldozer blade are again increased by the downward movement of the bulldozer blade, the operator returns the operating lever 100 to the neutral position N in order to reduce the load applied on the bulldozer blade so that the switch 47 is closed and the switch 49 is opened. As a result, the solenoid 40 is dienergized so that the valve position of the valve 3 is changed from the position D to the neutral position H, thereby changing the valve position of the valve 1 to the neutral position also by the action of another opposite spring provided therein. Thus, the hoist cylinder 60 is hydraulically locked so as to keep the bulldozer blade in the lowered position.

In accordance with the conditions of the quantity of soil and sand accumulated onto the bulldozer blade, degree of the shoe slip, revolution speed of the engine, degree of roughness of the ground surface, etc., the operator optionally operates the operating lever 100 of the manual operating switch unit 67 to move the bulldozer blade upwards or downward, thereby successively carrying out the levelling or excavating work.

(e) Floating operation of the bulldozer blade:

Further, when it is required to bring the bulldozer blade to make the floating operation, the operating lever 100 is shifted to the position III so that the switch 47 is opened and the switches 49 and 50 are closed. As a result, both the solenoids 40 and 44 are excited so that the valve position of the electromagnetic valve 3 is changed over to the lowering position D and, at the same time, the electromagnetic valve 6 is actuated. Under such conditions, the operating cylinder 35 is extended to the most extending position so that the valve position of the bulldozer blade hoisting valve 1 is changed over to a floating position I, thereby permitting the piston accommodated within the hoist cylinder 60 to extend and retract in response to the external forces applied to the cylinder 60 which is called in fluid mechanics as the floating condition or merely "float".

In general, when it is required to level once excavated soil and sand accumulated by the forward drive of the bulldozer, the floating operation of the bulldozer blade is used under the rearward drive of the bulldozer in which the excavated soil and sand is levelled by the back and the lower end of the bulldozer blade with utilizing the weight thereof.

AUTOMATIC MODE OF OPERATION

The automatic mode of operation of the bulldozer blade is explained with reference to FIGS. 12A to 12F.

(f) From preparation to start of levelling or excavating work:

After starting the engine of the bulldozer, the movable contact 45*a* of the auto-manual changeover switch 45 is moved so as to connect with the contact 45*d* for manual operation. Then, the main switch 46 is turned on. Under such conditions, the bulldozer is driven to a point P from which the levelling or excavating work is started, as is similar to the case of manual mode of operation. And, if it is necessary, the adjustment of the tilted blade as described in the foregoing paragraph (b-1) or (b-2) is previously carried out.

Subsequently, the contact 45*a* is moved to connect with the contact 45*b* for automatic downward operation of the bulldozer blade. Even though the contact 45*a* is changed over from the contact 45*d* for manual operation to the contact 45*b*, the movable contacts 5*b*, 5'*b*, 5''*b*, 7*b* and 7'*b* are kept to close as is described in the aforesaid paragraph (a) by the reasons of that self-maintaining action is exerted on the switch part $A_3$ and that both the switches 47 and 51 in the manual operating switch unit 67 are closed on, because the operating lever 100 for the unit 67 is set in the neutral position N. Moreover, the movable contacts 8*b* and 8'*b* of the load reading relay 8 are also closed to connect them with the contacts 8*c* and 8'*c*, respectively, because any signal is not generated from the load detecting circuit 11 by the reason of that, at that time, the load applied on the bulldozer blade is not acted.

Therefore, an electric signal generated from the power supply 42 is fed through, in turn, the contact 45*b*, the switch part $A_1$ of the safety relay 5, the switch part $B_2$ of the manual operation preferential relay 7, the switch part $C_1$ of the load reading relay 8 and the lower travel limit switch 69 into the solenoid 40 so as to excite the same, thereby causing the bulldozer blade to move downwards as described in the foregoing paragraph (d). On the occasion of this, if the operating point of the lower travel limit switch 69 has previously been adjusted such that the switch 69 is opened when the lower end of the bulldozer blade comes in contact with the ground, the bulldozer blade is stopped to such a position as coming in contact with the ground. (FIG. 12A)

Figure 12A:
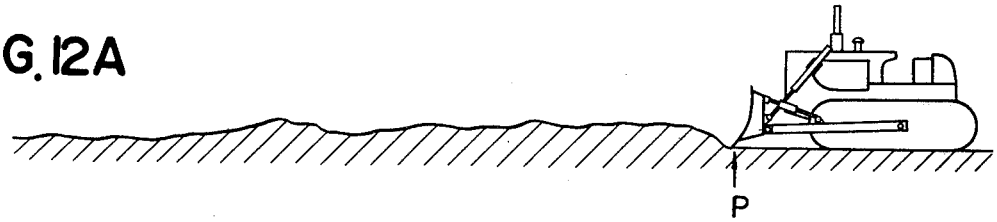
FIGS. 12A to 12F are explanatory views showing automatic operation mode of the bulldozer blade in the excavating or levelling work.
Figure 12B:
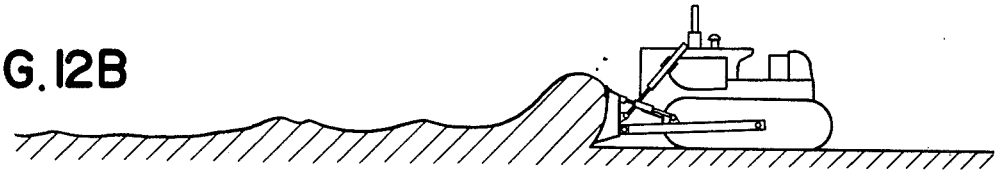

(g) Upward movement of the bulldozer blade:

When the bulldozer is forwarded from such a condition as shown in FIG. 12A and described in previous paragraph (f), excavated soil and sand are accumulated on the front face of the bulldozer blade. In consequence, as the load applied on the bulldozer blade exceeds a predetermined value for the load detecting device connected to the load detecting circuit 11, the coil 8*p* of the load reading relay 8 is energized by an output signal generated from the load detecting circuit 11 so that the movable contacts 8*b* and 8'*b* are closed to connect them with the contacts 8*c* and 8'*c*, respectively. At that time, since the upper travel limit switch 68 is closed on, the signal is fed therethrough into the solenoid 41, thereby exciting the same. On the contrary, the solenoid 40 is deenergized. Thus, the bulldozer blade is moved upwards as described in the foregoing paragraph (c). (FIG. 12B)

Figure 12C:
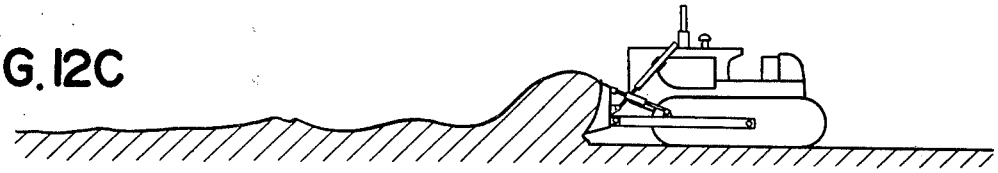

(h) Downward movement of bulldozer blade:

When the load applied on the bulldozer blade is reduced by the upward movement thereof as described in the previous paragraph (g) so that the load is less than the predetermined value, the output signal from the load detecting circuit 11 is extinguished so as to deenergize the coil 8*p* of the load reading relay 8. As a result, since the movable contacts 8*b* and 8'*b* are closed to connect them with the contacts 8*a* and 8'*a*, respectively, and yet the lower travel limit switch 69 having been closed because of the upward movement of the bulldozer blade, the solenoid 40 is excited, while the solenoid 41 is deenergized. Thus, the bulldozer blade is moved downwards as described in the aforesaid paragraph (d). (FIG. 12C)

Figure 12D:
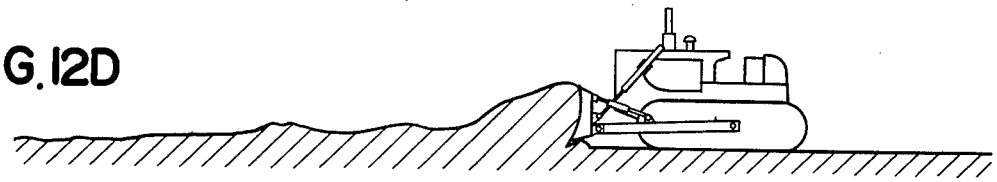

Thereafter, in response to increase and decrease of the load applied on the bulldozer blade, generation and extinction of the output signal from the load detecting circuit 11 are respectively repeated, thereby automatically moving the bulldozer blade upwards and downwards. (FIG. 12D)

Figure 12E:
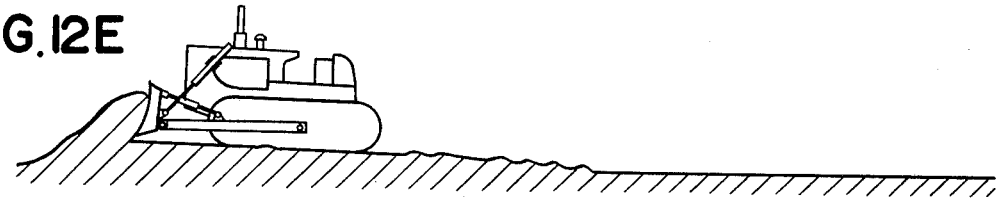

Just before the end of levelling or excavating work, such a condition as applying a load less than the predetermined value on the bulldozer blade is continued. Therefore, the lower travel limit switch 69 is opened by the downward movement of the bulldozer blade so that the bulldozer performs the levelling or excavating work in a manner such that the bulldozer blade is kept to the lower position dependent on the action of the lower travel limit switch 69. (FIG. 12E)

(i) Rearward drive of the bulldozer:

After the completion of one cycle of the forward drive, when it is required to drive the bulldozer rearwards, the movable contact 45*a* of the auto-manual changeover switch 45 is moved to connect it with the contact 45*c* for automatic upward movement of the bulldozer blade. In this case, the respective movable contacts 5*b*, 5'*b*, 5''*b*, 7*b* and 7'*b* are also kept to close by the reasons similar to the description in the foregoing paragraph (f). Of course, it is sure that the movable contacts 8*b* and 8'*b* of the relay 8 are closed to connect them with the contacts 8*c* and 8'*c*, respectively.

Therefore, an electric signal generated from the power supply 42 is fed through, in turn, the contact 45*c*, the switch part $A_2$ of the safety relay 5, the switch part $B_1$ of the manual operation preferential relay 7, the switch part $C_1$ of the load reading relay 8 and the upper travel limit switch 68 into the solenoid 41 so as to excite the same, thereby causing the bulldozer blade to move upwards as described in the foregoing paragraph (c). Subsequently, when the upper travel limit switch 68 is opened by the upward movement of the bulldozer blade, the solenoid is deenergized. Thus, the bulldozer is driven rearwards in a manner such that the bulldozer blade is kept to the upper position dependent on the action of the upper travel limit switch 68. (FIG. 12F)

Figure 12F:
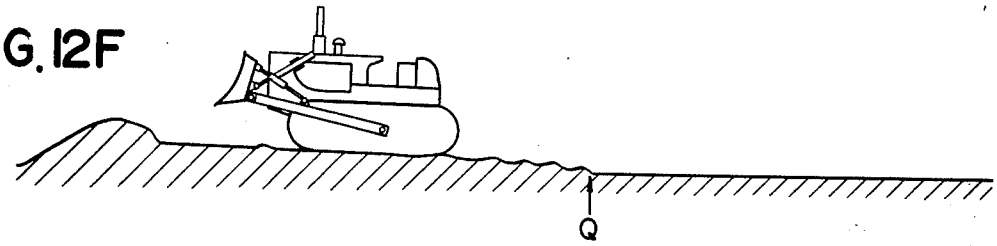

When, by the rearward drive of the bulldozer, the lower end of the bulldozer blade is come to a point Q shown in FIG. 12F, the operator stops the rearward drive of the bulldozer, and then moves the movable contact 45*a* of the auto-manual changeover switch 45 to connect the same with the contact 45*b* for the automatic downward movement of the bulldozer blade so as to return the bulldozer blade to the initial condition.

(j) Changeover to manual operation during automatic operation:

Even when the bulldozer blade is automatically operated, it is always possible to change into the manual operation by moving the operating lever 100 of the manual operating switch unit 67 to a desired position except for its neutral position N, with the result that the switch 47 or 51 is opened so that the movable contacts 7*b* and 7'*b* are opened to disconnect them from the contacts 7*a* and 7'*a*, respectively. As a result, the electric signal for the automatic operation is shut off to stop the same. Instead, the bulldozer blade is manually operated as described in the foregoing paragraphs (a) to (e) concerning the manual mode of operation.

On the contrary, when the operating lever 100 is shifted to the neutral position N, the switches 47 and 51 are closed, thereby closing the movable contacts 7*b* and 7'*b* to connect them with the contacts 7*a* and 7'*a*, respectively. Therefore, the electric circuit is returned to such a condition as operated by the automatic mode of operation.

Figure 3:
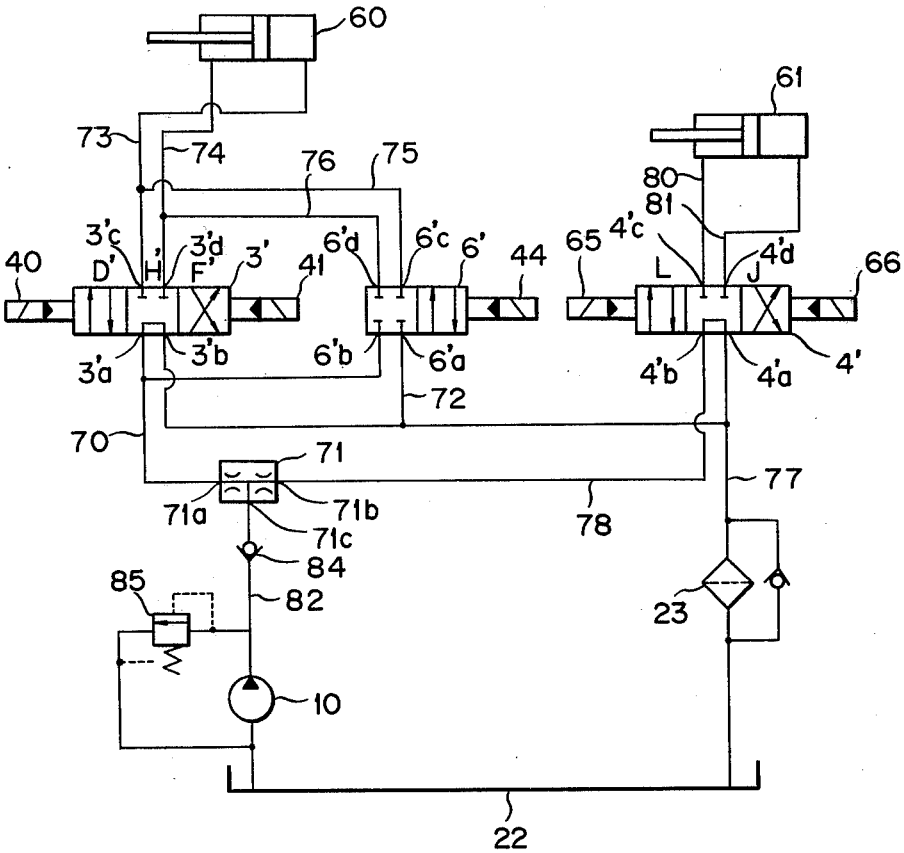
FIG. 3 is a hydraulic circuit of another embodiment of the present invention.

Referring to FIG. 3, there is shown another embodiment of the controlling apparatus of the present invention. In this embodiment, the electromagnetic valve 3' for hoisting the bulldozer blade has formed therein a port 3'a which is connected through a pipeline 70 with a port 71a formed in a flow divider 71. The electromagnetic valve 3' has also formed therein a port 3'b which is connected through a pipeline 72 with a port 6'a formed in an electromagnetic valve 6' for floating the bulldozer blade. The port 3'b is also connected through a pipeline 77 with a tank 22. The electromagnetic valve 3' has formed therein further ports 3'c and 3'd which are connected through pipelines 73 and 74 with the rod and head sides of the hoist cylinder 60, respectively. The electromagnetic valve 6' has formed therein a port 6'b which is connected with the port 3'a of the electromagnetic valve 3', and also has formed therein ports 6'c and 6'd which are connected through pipelines 75 and 76 with the head and rod sides of the hoist cylinder 60, respectively.

The electromagnetic valve 4' for tilting the bulldozer blade has formed therein a port 4'a connected through a pipeline 77 with a tank 22. The pipeline 77 is provided with a filter 23. The electromagnetic valve 4' has formed therein a port 4'b connected through a pipeline 78 with a port 71b of the flow devider 71, and also has ports 4'c and 4'd formed therein which are connected through pipelines 80 and 81 with the rod and head sides of a tilt cylinder 61, respectively.

The aforementioned flow divider 71 has formed therein a port 71c connected through a pipeline 82 with a pump 10. The pipeline 82 is provided with a check valve 84 and a relief valve 85.

The electric circuit of this embodiment is entirely the same as that of the first embodiment shown in FIG. 1 and described hereinabove. Therefore, since the mode of operation thereof is similar to that of the first embodiment, it is eliminated.

Figure 4:
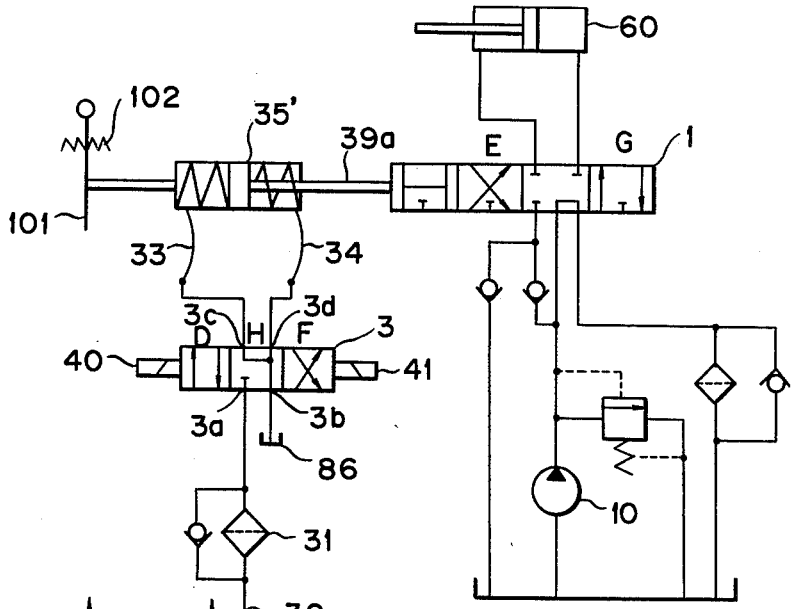
FIG. 4 is a hydraulic circuit of still another embodiment of the present invention.
Figure 13:
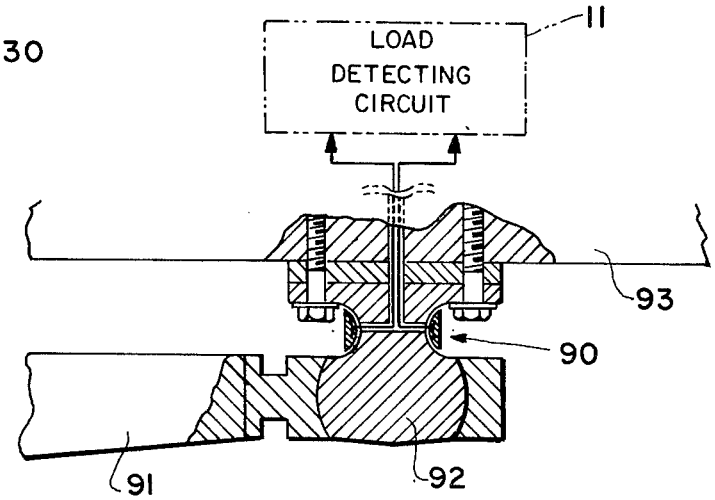
FIG. 13 illustrates the load detecting circuit of the present invention.

FIG. 4 illustrates a hydraulic circuit of a still further embodiment of the present invention. In the drawing, reference numeral 1 denotes a bulldozer blade hoisting valve. This bulldozer blade hoisting valve 1 serves to change the direction of flow of fluid under pressure delivered from the pump 10 between the head and rod sides of the hoist cylinder 60. The bulldozer blade hoisting valve 1 comprises a spool which is connected through a rod 39a to a piston slidably mounted within the operating cylinder 35'. An operating lever 101 is connected to the operating cylinder 35'. The operating lever 101 is provided with a centering spring 102 adapted to maintain the operating lever 101 at a central position when the operating cylinder 35' is actuated. Since the operating lever 101 is thus located at a central position as the operating cylinder 35' is actuated, the bulldozer blade hoisting valve 1 can be readily changed over. In the drawing, reference numeral 3 represents an electromagnetic valve having formed therein a port 3a which is connected through a pipeline 32 with the delivery side of a pump 30. The pipeline 32 is provided with a filter 31. The electromagnetic valve 3 has formed therein a port 3b which is connected to a tank 86, and also has ports 3c and 3d formed therein which are connected through pipelines 33 and 34 with the head and rod sides of the operating cylinder 35', respectively.

The electromagnetic valve 3 has a solenoid 40 for moving the bulldozer blade downwards and another solenoid 41 for moving the same upwards. One side terminals of the solenoids 40 and 41 are connected to the power supply 42. The other side terminal of the solenoid 40 is connected through a lower travel limit switch 69 with a contact 8a in the switch part $C_1$ of a load reading relay 8, whilst the other side terminal of the solenoid 41 is connected through an upper travel limit switch 68 with a contact 7a in the switch part $B_1$ of a manual operation preferential relay 7 and a contact 8c in the switch part $C_1$ of the load reading relay 8. Further, a contact 5d of the safety relay 5 and a contact 7'd of the manual operation preferential relay 7 are both connected with the power supply 42, and a contact 8'b in the switch part $C_2$ of the load reading relay 8 is connected through an overload indicating lamp 43 with the power supply 42.

A contact 5c in the switch part $A_1$ of the safety relay 5 and a contact 5'c in the switch part $A_2$ thereof are connected with the power supply 42 through an automatic operation indicating lamp 54 and a diode 12, and through the lamp 54 and a diode 13, respectively. The contact 5c in the switch part $A_1$ of the safety relay 5 and the contact 5'c in the switch part $A_2$ thereof are connected with a contact 8'c in the switch part $C_2$ of the load reading relay 8 through the diodes 12 and 13, respectively. Further, the contact 5c in the switch part $A_1$ of the safety relay 5 is connected with a movable contact 7'b in the switch part $B_2$ of the manual operation preferential relay 7, and the contact 5'c in the switch part $A_2$ of the safety relay 5 is connected with a movable contact 7b in the switch part $B_1$ of the manual operation preferential relay 7.

The load reading relay 8 comprises a coil 8p which is connected with a load detecting circuit 11. Any type of load detecting circuit may be used which can produce a signal for energizing the coil 8p as the load imposed on the bulldozer blade exceeds a predetermined value. The movable contact 8b in the switch part $C_1$ of the load reading relay 8 is connected with a contact 7'a in the switch part $B_2$ of the manual operation preferential relay 7.

Figure 14:
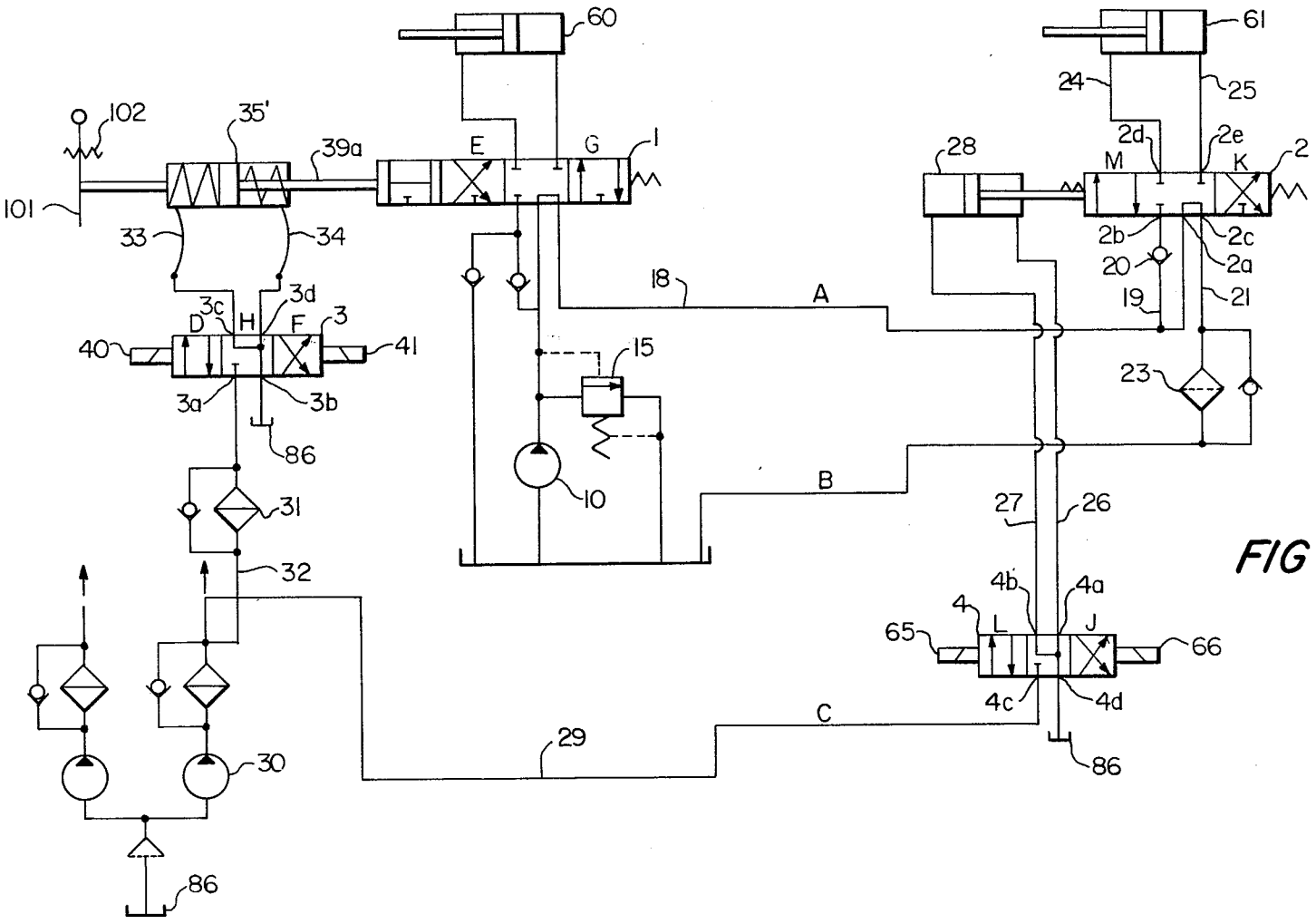
FIG. 14 is a hydraulic circuit of the embodiment of FIG. 4 combined with the tilt cylinder circuit of the embodiment of FIG. 1.

FIG. 14 is the hydraulic circuit of the embodiment of FIG. 4 combined with the tilt cylinder circuit of the embodiment of FIG. 1.

Figure 5:
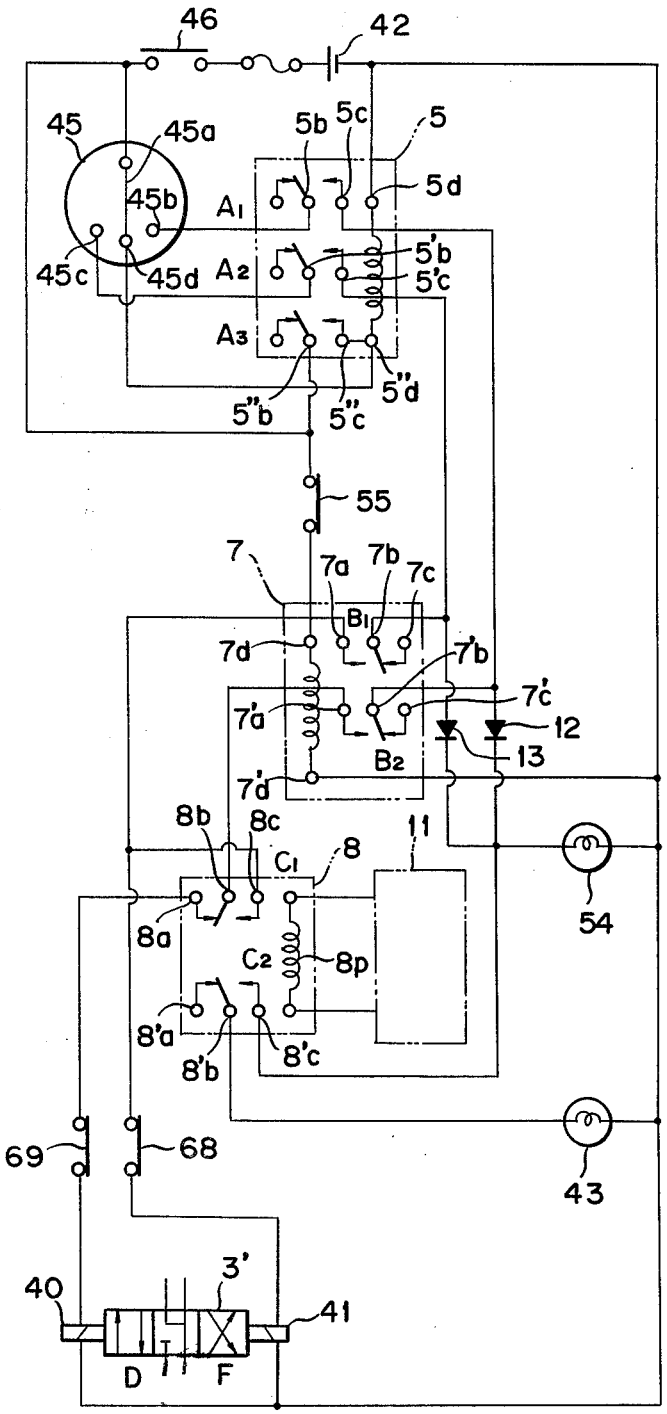
FIG. 5 is an electric circuit of the present invention for use with the hydraulic circuit of FIG. 4.

In FIG. 5, the reference numeral 45 denotes an auto-manual change-over switch. A movable contact 45a of the switch 45 is connected through a main switch 46 with a power supply 42. A contact 45b in the switch 45 for automatic downward operation is connected with the movable contact 5b in the switch part $A_1$ of the safety relay 5, and a contact 45c in the switch 45 for automatic upward operation is connected with a movable contact 5'b in the switch part $A_2$ of the safety relay 5. A contact 45d for manual operation is connected with a contact 5''d of the safety relay 5. The movable contact 5''b in the switch part $A_3$ of the safety relay 5 is connected through the main switch 46 with the power supply 42. One terminal of a switch 55 interlocked with the manual operating lever 101 is connected through the main switch 46 with the power supply 42, and the other terminal of the switch 55 is connected with the contact 7d of the manual operation preferential relay 7.

Now, the operation of this embodiment will be described below.

When the main switch 46 is turned on, movable contacts 5b, 5'b, and 5''b of the safety relay 5 are moved to the right and closed on the contacts 5c, 5'c and 5''c only when the auto-manual change-over switch 45 occupies its manual position 45d. Further, the movable contacts 7b and 7'b of the manual operation preferential relay 7 are both moved to the left and closed on the contacts 7*a* and 7'*a*.

When the contact 45*b* for automatic downward operation is then actuated, a signal is fed through the switch part $A_1$ of the safety relay 5, the switch part $B_2$ of the manual operation preferential relay 7, the switch part $C_1$ of the load reading relay 8 and the lower travel limit switch 69 into the solenoid 40 for moving the bulldozer blade downwards, because of self-holding action of the switch part $A_3$ of the safety relay 5. This is with the case the load imposed on the bulldozer blade is small. When the load imposed on the bulldozer blade exceeds a predetermined value, the coil 8*p* of the load reading relay 8 is energized so that the movable contact 8*b* in the switch part $C_1$ of the relay 8 comes into contact with the contact 8*c* and so the signal is fed through the upper travel limit switch 68 into the solenoid 41 for moving the bulldozer blade upwards. When the signal is fed into the solenoid 40 for moving the bulldozer blade downwards, lowering position D is located on the side of th port in the electromagnetic valve 3 so that the operating cylinder 35' is rendered operative. As a result, lowering position E is located on the side of the port in the bulldozer blade hoisting valve 1 so that the hoist cylinder 60 is actuated to move the bulldozer blade downwards.

Further, when the signal is fed into the solenoid 41 for moving the bulldozer blade upwards, raising position F is located on the side of the port in the electromagnetic valve 3 so that the operating cylinder 35' is rendered operative. Consequently, in the bulldozer blade hoisting valve 1, raising position G is located on the side of the port so that the hoist cylinder 60 is actuated to move the bulldozer blade upwards.

After that, the above-mentioned cycle is made repeatedly in response to the load imposed on the bulldozer blade being increased or decreased. When the bulldozer blade moves beyond the previously set lower or upper travel limit, either of the lower travel limit switch 69 or the upper travel limit switch 68 is turned off so that neutral position H is located on the side of the port in the electromagnetic valve 3 thereby to stop the bulldozer blade.

When the contact 45*c* for automatic upward operation is then placed at "on" position, the signal is fed through the switch part $A_2$ of the safety relay 5, the switch part $B_1$ of the manual operation preferential relay 7 and the upper travel limit switch 68 into the solenoid 41. Therefore, the bulldozer blade is moved upwards and then stopped where the upper travel limit switch 68 is turned off.

The bulldozer blade can be floated, and moved upwards and downwards even by the aid of the operating lever 101. In this case, the switch 55 interlocked with the operating lever 101 is turned off, the coil of the manual operation preferential relay 7 is deenergized so that the movable contacts 7*b* and 7'*b* moves to the right and open the contacts 7*a* and 7'*a* thereby to open the circuit for automatic operation which results in stopping the automatic operation.

Figure 6:
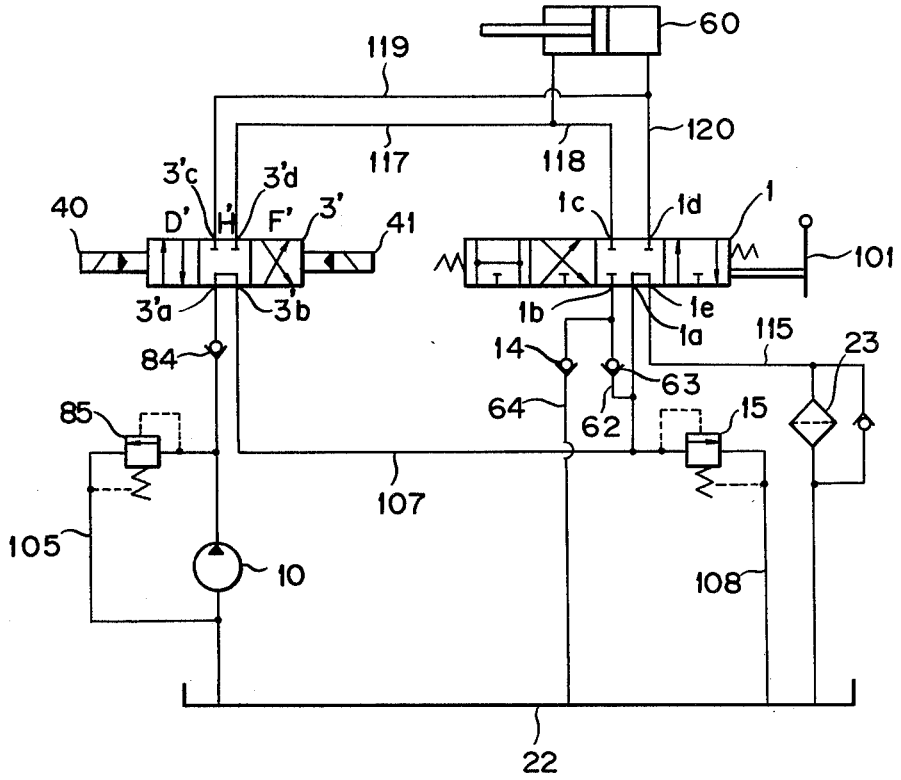
FIG. 6 is a hydraulic circuit of still another embodiment of the present invention.

FIG. 6 shows a hydraulic circuit of still further embodiment of the present invention. In this embodiment, electromagnetic valve 3' has formed therein a port 3'*a* which is connected through a check valve 84 to a pum 10, and a pipeline 105 extends between the suction and delivery sides of the pump 10.

The pipeline 105 is provided with a relief valve 85. The electromagnetic valve 3' has formed therein a port 3'*b* which is connected through a pipeline 107 with a port 1*a* of the bulldozer blade hoisting valve 1, and also has a port 3'*b* which is connected through a pipeline 108 with a tank 22. The pipeline 108 is provided with a relief valve 15. The pipeline 107 has a branch pipeline 62 extending therefrom which is connected with a port 1*b* of the bulldozer blade hoisting valve 1. A check valve 63 is provided in the branch pipeline 62. Further, the port 1*b* is connected through a pipeline 64 to the tank 22, and a check valve 14 is provided in the pipeline 64.

The bulldozer blade hoisting valve 1 has formed therein a post 1*e* which is connected through a pipeline 115 with the tank 22. The pipeline 115 is provided with a filter 23.

A port 3*d* of the electromagnetic valve 3' and a port 1*c* of the bulldozer blade hoisting valve 1 are connected through pipelines 117 and 118, respectively, with the rod side of the hoist cylinder 60. Further, the ports 3*c* and 1*d* are connected through pipeline 119 and 120, respectively, with the head side of the hoist cylinder 60. An operating lever 101 is connected to a spool of the bulldozer blade hoisting valve 1.

The electric circuit of this embodiment is entirely same as those of the above-mentioned embodiments in FIG. 5.

When a signal is fed into the solenoid 40 for moving the bulldozer blade downwards, lowering position D' is located on the side of the port in the electromagnetic valve 3' so that the hoist cylinder 60 is rendered operative thereby moving the bulldozer blade downwards. Whilst, when a signal is fed into the solenoid 41 for moving the bulldozer blade upwards, raising position F' is located on the side of the port in the electromagnetic valve 3' so that the hoist cylinder 60 is actuated to move the bulldozer blade upwards.

By operating the bulldozer blade hoisting valve 1 by means of the operating lever 101 when the electromagnetic valve 3' occupies its neutral position H', the hoist cylinder 60 can be actuated to control the bulldozer blade.

Figure 15:
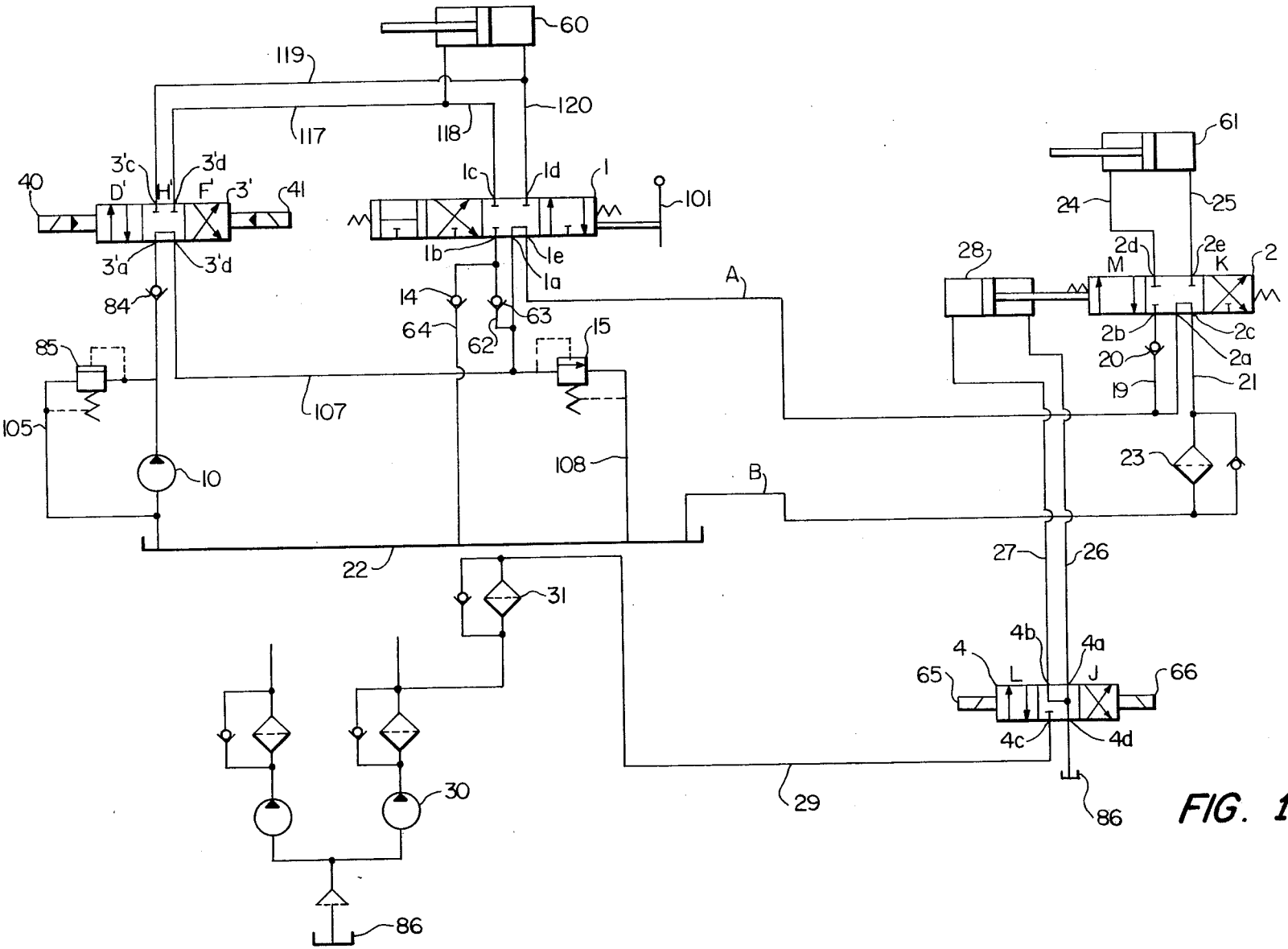
FIG. 15 is a hydraulic circuit of the embodiment of FIG. 6 combined with the tilt cylinder circuit of the embodiment of FIG. 1.

FIG. 15 is the hydraulic circuit of the embodiment of FIG. 6 combined with the tilt cylinder circuit of the embodiment of FIG. 1.

Although exemplary embodiments of the present invention have been shown and described, many changes, modifications and substitutions may be made by one having ordinary skill in the art without necessarily departing from the spirit and scope of the present invention.

What is claimed is:

1. A controlling apparatus for the operation of a bulldozer blade, comprising:

(a) a hydraulic circuit connected between a hydraulic power source and cylinder means including a hoist cylinder for hoisting and lowering the bulldozer blade and a tilt cylinder for tilting the same, said hydraulic circuit including electromagnetic valve means for controlling said cylinder means;

(b) an electric circuit electrically connected between an electric power source supply for supplying an electric signal into said electric circuit and said electromagnetic valve means, to effect manual and automatic operations of the bulldozer blade said electric circuit including a main switch, first switching means for selectively changing said electric circuit into a circuit for the manual operation or a circuit for the automatic operation, a safety relay connected with said first switching means adapted to be actuated only when said first switching means is maintained in a position where said electric circuit is changed into the manual operation circuit thereby preventing unexpected operation of said blade, a manual operation preferential relay connected with said safety relay, a load reading relay connected with said safety and manual operation preferential relays and adapted to be actuated by a signal fed from a load detecting circuit so as to send the electric signal from said manual operation preferential relay to one of the solenoids of said electromagnetic valve means, and second switching means manually controlled by the operation of an operating lever and adapted to turn off said manual operation preferential relay with the result of opening the automatic operation circuit when said second switching means is turned off in response to the operation of the operating lever for effecting the manual operation of the bulldozer blade; and (c) means for detecting a load applied to the bulldozer blade, said load detecting means being mounted on a push arm for supporting the bulldozer blade and being electrically connected with said load detecting circuit.

2. A controlling apparatus as claimed in claim 1, wherein said electromagnetic valve means comprises:

(a) a first electromagnetic valve for the hoisting or lowering operation of the bulldozer blade, said first electromagnetic valve being adapted to control the hoist cylinder;

(b) a second electromagnetic valve for the floating operation of the bulldozer blade, said second electromagnetic valve being adapted to control the hoist cylinder; and (c) a third electromagnetic valve for the tilting operation of the bulldozer blade, said third electromagnetic valve being adapted to control the tilting cylinder.

3. A controlling apparatus as claimed in claim 1, wherein said hydraulic circuit is further provided therein with hoisting valve means for controlling the hoist cylinder.

4. A controlling apparatus as claimed in claim 3, wherein said hoisting valve means comprises a bulldozer blade hoisting valve and an operating cylinder means having two rods at each side thereof, one of said two rods being fixedly connected to said hoisting valve, said operating cylinder means being adapted to be actuated by the operation of said electromagnetic valve means so as to control said hoisting valve.

5. A controlling apparatus as claimed in claim 1, wherein said hydraulic circuit is further provided therein with bulldozer blade tilting valve means for controlling the tilt cylinder, said bulldozer blade tilting valve means being hydraulically connected between the tilt cylinder and said electromagnetic valve means by the interposition of a second operating cylinder adapted to control said bulldozer blade tilting valve means.

6. A controlling apparatus as claimed in claim 4, wherein the other rod of said operating cylinder means is rigidly connected to a fixed member of a bulldozer body.

7. A controlling apparatus as claimed in claim 4, wherein the other rod of sad operating cylinder means is connected to a manual operating level.

8. A controlling apparatus as claimed in claim 2, wherein a flow divider is provided between said first electromagnetic valve and said third electromagnetic valve.

9. A controlling apparatus as claimed in claim 3, wherein said hoisting valve means is directly connected to the manual operating lever.

* * * * *